US007386925B2

(12) United States Patent
Germer

(10) Patent No.: US 7,386,925 B2
(45) Date of Patent: Jun. 17, 2008

(54) PROCESS AND APPARATUS FOR THE PRODUCTION OF ARTIFICIAL GRASS

(75) Inventor: Roger Germer, Coburg (DE)

(73) Assignee: Dietze & Schell Maschinenfabrik, Coburg (DE)

( * ) Notice: Subject to any disclaimer, the term of this patent is extended or adjusted under 35 U.S.C. 154(b) by 0 days.

(21) Appl. No.: 11/542,223

(22) Filed: Oct. 4, 2006

(65) Prior Publication Data

US 2008/0083103 A1 Apr. 10, 2008

(51) Int. Cl.
*D02G 1/12* (2006.01)

(52) U.S. Cl. ..... 28/263; 28/265; 28/257; 28/221

(58) Field of Classification Search ..... 28/263, 28/266, 265, 254, 256, 257, 264, 267, 268, 28/270, 247, 250, 255, 258, 221; 264/211.14, 264/211.15, 211.17, 211.18, 168, 282, 518
See application file for complete search history.

(56) References Cited

U.S. PATENT DOCUMENTS 3,156,028 A * 11/1964 Weiss et al. ..... 28/257
3,654,677 A * 4/1972 Binford et al. ..... 28/220
3,810,285 A * 5/1974 Ferrier et al. ..... 28/254
3,887,972 A * 6/1975 Bauch ..... 28/257
4,019,228 A * 4/1977 Ozawa et al. ..... 28/221
4,030,169 A * 6/1977 Enneking et al. ..... 28/220
4,133,087 A * 1/1979 Li et al. ..... 28/257
4,301,578 A * 11/1981 Dammann et al. ..... 28/256
4,319,388 A * 3/1982 Champaneria et al. ..... 28/257
4,908,919 A * 3/1990 Irvine ..... 28/250
4,974,302 A * 12/1990 Nabulon ..... 28/256
5,251,363 A * 10/1993 Gerhards et al. ..... 28/221
6,240,609 B1 * 6/2001 Rasnick et al. ..... 28/258
6,983,519 B2 * 1/2006 Wirz ..... 28/266
7,150,083 B2 * 12/2006 Schemken et al. ..... 28/266

* cited by examiner

*Primary Examiner*—Amy B Vanatta
(74) *Attorney, Agent, or Firm*—Westerman, Hattori, Daniels & Adrian, LLP.

(57) ABSTRACT

The invention describes a process and an apparatus for the production of highly crimped polymer strips which are suitable for use in artificial turf surfaces, for example for football pitches, hockey pitches, tennis courts or golf courses, and are characterized by a high degree of strength, a large volume and a high elasticity. The texturing of the polymer strips is carried out by means of a stuffer box, wherein the polymer strips are laid on a cooling godet immediately after the stuffer box.

11 Claims, 2 Drawing Sheets

PROCESS AND APPARATUS FOR THE PRODUCTION OF ARTIFICIAL GRASS

FIELD OF THE INVENTION

The invention describes a process and an apparatus for the production of textured filament strips for artificial grass, wherein these strips are stretched or shrunken between two heating godets and then textured, and the textured filament strips are drawn off over a cooling godet and then spooled.

BACKGROUND OF THE INVENTION

The knit-deknit process is mostly used for the texturing of thermoplastic polymer fibres. In addition, gear crimping is also customary for the production of fibres for artificial grass.

A draw texturing process in which a stuffer box is used in which a cooling zone is provided is known from the textbook "Synthetische Fasern" by Franz Fourné (see page 433, FIG. 4.255, right-hand side of the figure).

The texturing of threads by means of a stuffer box is also known from DE 21 42 652 and DD 221 214.

The knit-deknit process is used for the production of crimped fibres. EP 0 263 566 describes the production of crimped polypropylene fibres for artificial turf with the knit-deknit process. However, the degree of texturing is limited in these processes.

A process for the crimp texturing of an extruded yarn in which the extruded yarn is first stretched through two heating rollers, then crimped in a texturing unit and subsequently cooled via a cooling drum with a certain number of turns is known from DE 38 00 773. The texturing unit is a plug former. To cool the textured yarn, cooling air is sucked through holes located on the outside of the cooling drum.

A cooling godet or roller for the treatment of synthetic thread- or web-shaped goods is also known from DE 28 44 207.

An apparatus for the continuous crimping of thermoplastic yarns with which the crimping (texturing) is carried out with a stuffer box mounted tangentially on a rotary cylinder and the rotary cylinder is used for cooling is known from DE 21 10 670. For this, openings through which cooling air is passed over the cylinder and a cover plate are mounted on the outside of the rotary cylinder next to the stuffer box.

A process for the production of low-shrinkage strips in which flat strips, strands or monofilaments made of plastic are stretched in a stretching station and fixed in a fixing station is known from DE 43 18 689.

The cooling of threads is known from EP 0 003 952, wherein these threads are formed from thread plugs formed in stuffer boxes and then spooled on an air-permeable drum and cooled. There is a substantial distance between the stuffer box and the cooling godet.

SUMMARY OF THE INVENTION

It is an object of the present invention to provide a process and an apparatus for the production of highly crimped polymer strips which are suitable for use in artificial turf surfaces, for example for football pitches, hockey pitches, tennis courts or golf courses, and are characterized by a high degree of strength, a large volume and a high elasticity.

It is a further object of the present invention to provide a process for the production of textured filament strips for artificial grass, comprising the steps of stretching filament strips between two heating godets; texturing the filament strips in a stuffer box; and drawing off the textured filament strips over a cooling godet and laying the textured filament strips on the cooling godet immediately after the texturing.

Preferably, up to ten strips are processed simultaneously and the strips are 0.5-1.5 mm wide and have a linear density of 250-1200 dtex.

The filament strip can also be a monofilament tape which is 1.5-8 mm wide and has a linear density of 500-8000 dtex.

The filament strip leaving the stuffer box is preferably fed approximately radially to the cooling godet.

An additional air nozzle is preferably mounted above the cooling godet and laterally beside the stuffer box. The additional air nozzle supports the laying of the material on the cooling godet.

The stuffer box is to be mounted at as small as possible a distance above the cooling godet. The laying on the cooling godet takes place without the use of feeder rolls, as the texturing would be destroyed again as a result of using feeder rolls.

A guide groove is located on the outside of the cooling godet. The guide groove is provided with small openings. The radius of the guide groove is matched to the texturing of the textured materials in order to avoid deformations of the texturing. The cooling godet is provided with a suction device which sucks air through the openings in the guide groove in order to cool the filament strip laid in the groove and keep it in the groove. A rapid cooling of the material is thereby achieved and the texturing is fixed by the onset of crystallization. In addition, an upright cover is incorporated into the cooling godet in order that the suction action is confined to the section of the periphery of the cooling godet in which the thread lies in the guide groove. The filament is drawn off from the cooling godet by a draw-off godet.

DETAILED DESCRIPTION OF THE EMBODIMENTS

Figure 1:
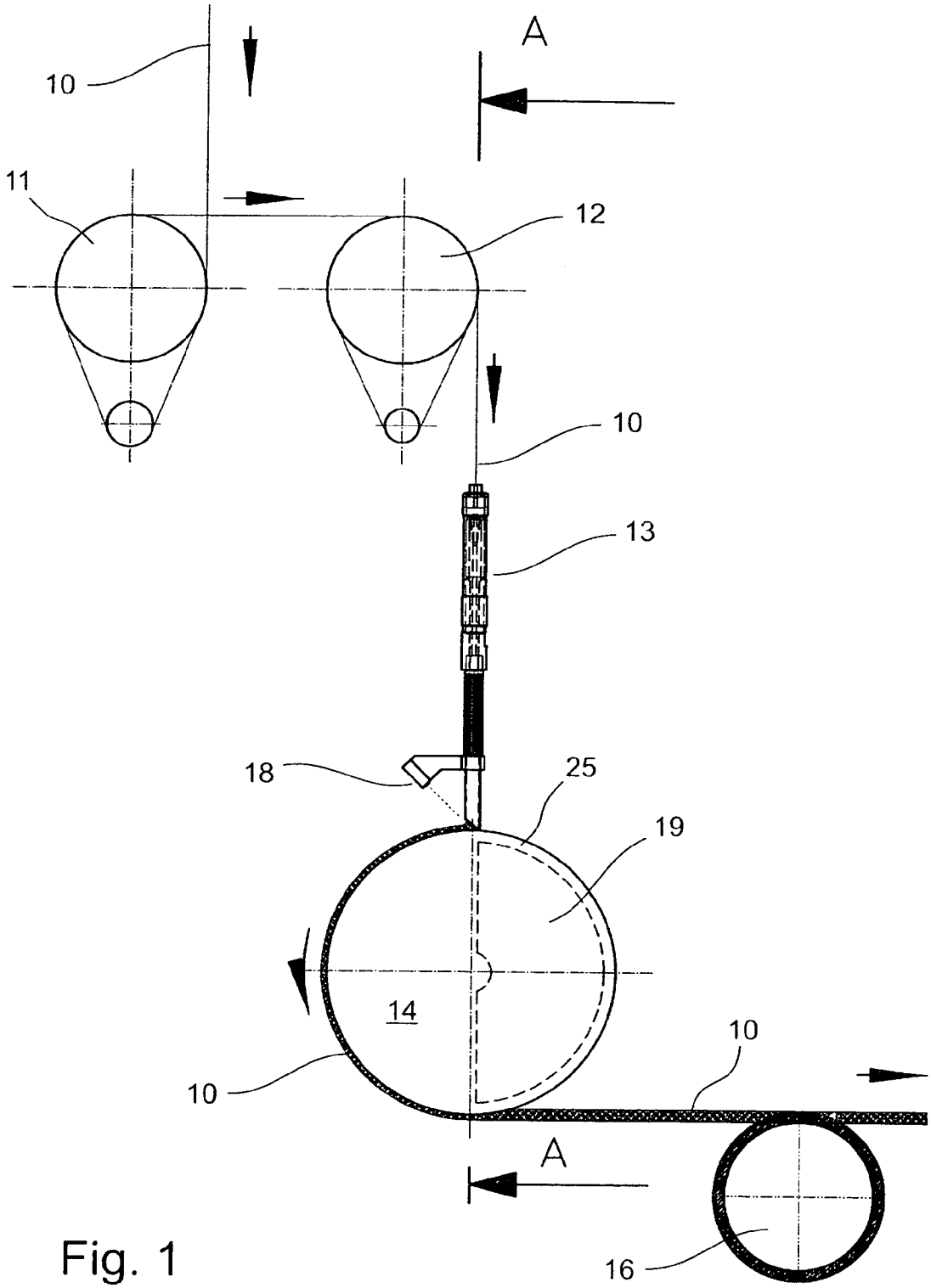
FIG. 1 shows diagrammatically the device for carrying out the process.

In the present process, a polymer material in the form of strips 10, 0.5 to 1.5 mm wide and with a linear density of 250-1200 dtex, is processed. PA (polyamide), PP (polypropylene) HDPE (high density polyethylene) or LLDPE (linear low density polyethylene) are used for example as polymeric materials. The strips 10 are further processed either fed from a creel or direct on leaving the extruder.

For further processing, four to ten strips 10 are bundled into a multifilament and thermally stretched or shrunken by up to 20% over two heating godets 11 and 12.

The strips 10 are then subjected to a hot-air texturing process in a stuffer box 13, wherein the strips 10 are pressed into a box and knocked against the fibre plug forming there. The filaments buckle up against one another. The stuffer box has a lateral inlet for a hot-air texturing nozzle 21 and an air outlet zone 23. The resulting structure is thermoset while still in the box with hot air from the texturing nozzle 21. A three-dimensional, sawtooth-shaped crimp structure forms. Stuffer boxes customary in the trade can be used in the process.

To stabilize the texturing, the compressed and crimped strips 10 are taken up by a cooling godet 14 immediately after the texturing. The cooled strips 10 are drawn off from the cooling godet 14 by a draw-off godet 16 and fed to a spooling machine. The degree of texturing is limited by the speed ratio of the cooling godet 14 to the draw-off godet 16, the speed ratio of the draw-off godet 16 to the second heating godet 12, and the air pressure in the stuffer box 13.

The discharge end of the stuffer box is arranged as near as possible to the surface of the cooling godet 14, and the stuffer box 13 ends just a few millimeters above the cooling godet 14. The filament strip 10 leaving the stuffer box 13 is conducted radially onto the cooling godet 14. In addition, there is mounted laterally on the stuffer box 13 an air nozzle 18 which directs an air jet at an angle of approximately 45° to the longitudinal axis of the discharge end of the stuffer box 13 and the surface of the cooling godet 14 onto the point at which the filament strip 10 leaves the stuffer box 13 and is laid on the cooling godet 14. The laying of the filament strip 10 on the cooling godet 14 is thereby supported.

Figure 2:
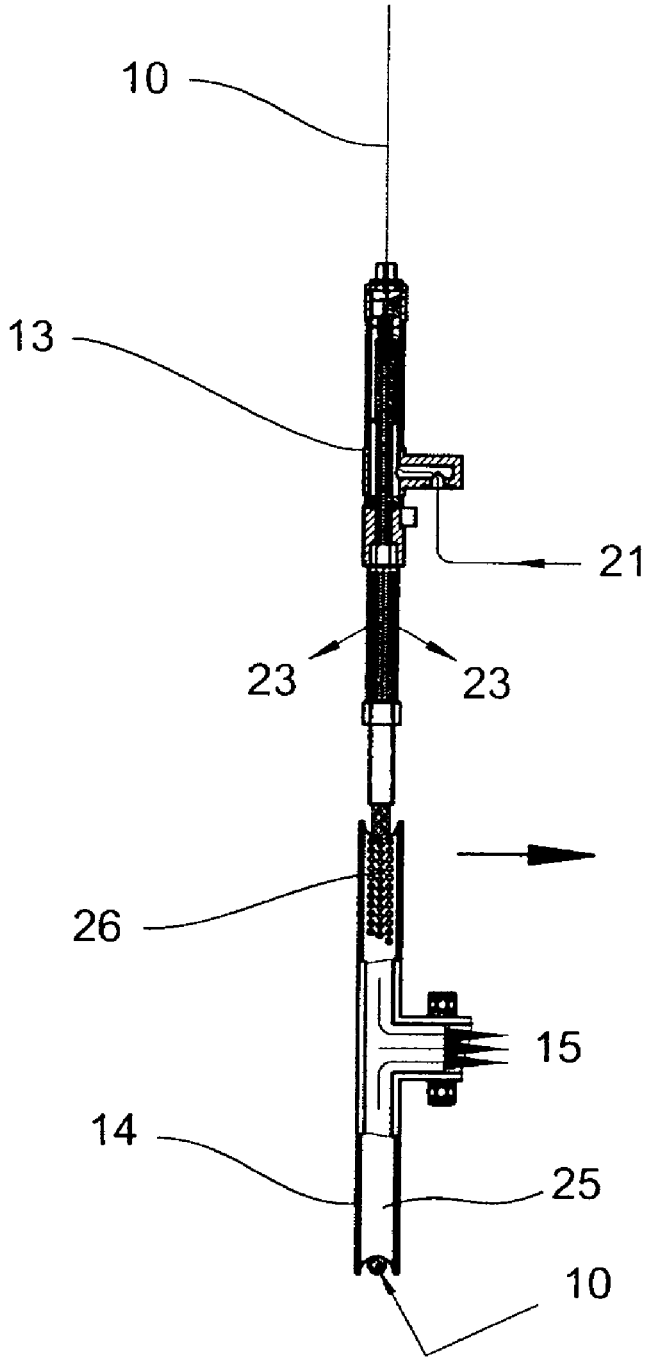
FIG. 2 shows in section along A-A of FIG. 1 the stuffer box and the cooling godet with a suction device.

As shown in FIG. 2, the cooling godet 14 has a suction device 15. Arranged on the outside of the cooling godet 14 is a radial guide groove 25 with small openings 26 through which air is sucked in from the outside and which ensure an air throughput sufficient for cooling. The radius of the guide groove 25 is matched to the textured material. The filament strips 10 generally rest against the cooling godet 14 on a circular arc of less than 360°, e.g. approximately 180°. Incorporated into the cooling godet 14 is an upright cover 19 which shields from the inside the part of the guide groove 25 on which no filament strips lie. Unnecessary consumption of suction air and an unnecessary reduction of the negative pressure in the cooling godet 14 are thereby avoided. Wrapping of the filament strips 10 around the cooling godet 14 is also avoided thereby because the textured filament strips drop down from the cooling godet 14 as from the beginning of the cover 19 due to their own weight and the absence of the suction.

The textured strips 10 are held and cooled by the suction air at the cooling godet 14 in their guide groove 25 in the desired segment of e.g. approximately 180° on the periphery of the cooling godet 14. The cooling quickly reduces the temperature to below the glass-transition temperature with the result that the texture of the fibres is fixed by the onset of crystallization.

The speed ratios of the godets are variable and can be adjusted according to the desired degree of texturing. Particularly important here is the speed ratio between the second heating godet 12, the cooling godet 14 and the draw-off godet 16, as this determines the degree of texturing. The cooling godet 14 travels by the factor 5 to 20 slower than the second heating godet 12 and the draw-off godet 16 travels by the factor 2 to 4 slower than the second heating godet 12.

The speed difference between extrusion and spooling is 5-35%, wherein the extrusion speed is 1.05 to 1.35 times greater than the spooling speed. Production speeds of 100-500 m/min. can thus be reached.

The thus-obtained fibres can then be bundled as fibre groups and anchored on dimensionally stable backing fabric, whereby an artificial turf surface with high elasticity, an optimum recovery capacity and high wear resistance is obtained.

EXAMPLE

Six extruded polyamide strips 10 are stretched by 10% at 160° C. over the two heating godets 11 and 12 with a thread tension of 4000 g. The stretched strips 10 are then compressed and crimped in the stuffer box 13 with a texturing pressure of 5 bar and thermoset at 120° C. texturing nozzle temperature. There is a back shrinkage of 35%. The textured strips 10, supported by an air jet from the lateral air nozzle 18, are laid tensionless on the cooling godet 14 and held, cooled and transported further in the guide groove of the cooling godet 14 by the air jet from the suction device 15. The temperature at the cooling godet 14 corresponds to the ambient temperature. The cooled strips 10 are taken up by the draw-off godet 16 and fed to the spooling machine, wherein the spooling tension is 300 g. The speed difference between extrusion and spooling is 25% and thus compensates for the back shrinkage. A production speed of 400 m/min. is reached.

LIST OF REFERENCE NUMBERS

10 strip
11 first heating godet
12 second heating godet
13 stuffer box
14 cooling godet
15 suction device
16 draw-off godet
18 air nozzle
19 upright cover
21 texturing nozzle
23 air outlet zone
25 guide groove
26 openings

What is claimed is:

1. A process for the production of textured filament strips made of a polymer material for artificial grass, comprising the steps of stretching or shrinking filament strips between two heating godets;

texturing the filament strips in a stuffer box comprising a discharge end where the filament strips leave the stuffer box;

drawing off the textured filament strips over a cooling godet comprising a guide groove and laying the textured filament strips in the guide groove of the cooling godet immediately after the texturing, wherein the filament strips are fed approximately radially to the cooling godet and wherein the step of laying of the textured filament strips in the guide groove is supported by an air nozzle arranged laterally on the stuffer box which directs an air jet at the discharge point of the stuffer box at an angle of approximately 45° to the longitudinal axis of the discharge end of the stuffer box; and spooling the textured filament strips.

2. The process according to claim 1, wherein air for cooling is sucked by means of a suction device through openings mounted in the guide groove.

3. The process according to claim 1, wherein the filament strips are processed directly on leaving an extruder and the spooling speed is 100-500 m/min. and an extrusion speed is up to 35% greater than the spooling speed.

4. The process according to claim 1, wherein the filament strips are stretched between the heating godets up to 20%.

5. The process according to claim 1, wherein the polymer material comprises one of the polymers of the group consisting of polyamide, polypropylene, HDPE (high density polyethylene) and LLDPE (linear low density polyethylene).

6. The process according to claim 1, wherein up to ten strips are processed simultaneously and the strips are 0.5-1.5 mm wide and have a linear density of 250-1200 dtex.

7. The process according to claim 1, wherein the filament strip is a monofilament tape which is 1.5-8 mm wide and has a linear density of 500-8000 dtex.

8. The process according to claim 1, wherein the guide groove has a radius which is matched to the filament strips.

9. The process according to claim 1, wherein the cooling godet is arranged at a distance of a few millimeters from the discharge end of the stuffer box.

10. An apparatus for the production of textured filament strips for artificial grass, comprising:

two heating godets for stretching or shrinking the filament strips;

a stuffer box for texturing the filament strips, the stuffer box comprising a discharge end where the filament strips leave the stuffer box;

a cooling godet downstream of the stuffer, the cooling godet being arranged at a distance of a few millimeters from the discharge end of the stuffer box; and an air nozzle arranged laterally on the stuffer box, the air nozzle directing an air jet at the discharge end of the stuffer box at an angle of approximately 45° to the longitudinal axis of the discharge end of the stuffer box.

11. The apparatus according to claim 10, wherein the cooling godet comprises a guide groove having a radius which is matched to the filament strips.

* * * * *